US010906292B2

(12) United States Patent
Chung

(10) Patent No.: US 10,906,292 B2
(45) Date of Patent: Feb. 2, 2021

(54) HORIZONTAL ROTARY SCREEN TRANSFER PRINTING APPARATUS

(71) Applicants: Newtech Textile Technology Development (Shanghai) Co., LTD, Shanghai (CN); Po-Wen Chung, Shanghai (CN)

(72) Inventor: Po-Wen Chung, Shanghai (CN)

(73) Assignees: NEWTECH TEXTILE TECHNOLOGY DEVELOPMENT (SHANGHAI) CO., LTD, Shanghai (CN); CHUNG, PO-WEN, Shanghai (CN)

( * ) Notice: Subject to any disclaimer, the term of this patent is extended or adjusted under 35 U.S.C. 154(b) by 0 days.

(21) Appl. No.: 16/618,857

(22) PCT Filed: Jun. 6, 2018

(86) PCT No.: PCT/CN2018/090066
§ 371 (c)(1),
(2) Date: Dec. 3, 2019

(87) PCT Pub. No.: WO2019/001234
PCT Pub. Date: Jan. 3, 2019

(65) Prior Publication Data

US 2020/0164630 A1 May 28, 2020

(30) Foreign Application Priority Data

Jun. 28, 2017 (CN) ..... 2017 1 0504257

(51) Int. Cl.
*B41F 15/08* (2006.01)
*B41F 15/40* (2006.01)
(Continued)

(52) U.S. Cl.
CPC ..... *B41F 15/46* (2013.01); *B41F 15/08* (2013.01); *B41F 15/36* (2013.01); *B41F 15/42* (2013.01); *B41F 16/02* (2013.01); *B41P 2215/50* (2013.01)

(58) Field of Classification Search
CPC ..... B41F 15/46; B41F 15/08; B41F 15/36; B41F 15/42; B41F 16/02; B41F 15/0831;
(Continued)

(56) References Cited

U.S. PATENT DOCUMENTS 3,291,044 A * 12/1966 Der Winden ..... B41F 15/0836 101/118
3,915,087 A * 10/1975 Tiemann ..... B41F 15/0872 101/115
(Continued)

FOREIGN PATENT DOCUMENTS

AT 408670 A 2/2002
AT 408670 B 2/2002
(Continued)

OTHER PUBLICATIONS

International Search Report issued in application No. PCT/CN2018/090066.

*Primary Examiner* — Leslie J Evanisko
(74) *Attorney, Agent, or Firm* — McCLure, Qualey & Rodack, LLP.

(57) ABSTRACT

A horizontal rotary screen transfer printing device includes a frame, two or more sets of rotary screen transfer printing assemblies which are horizontally disposed on the frame, and a back-pressure roller. Each rotary screen transfer printing assembly includes a rotary screen plate roller and a transfer roller arranged parallel to each other. The rotary screen plate roller transfers a pattern onto the transfer roller serving as a temporary transfer carrier. The transfer roller
(Continued)

transfers the pattern onto a fabric passing between the back-pressure roller and the transfer roller in a horizontal direction.

16 Claims, 2 Drawing Sheets

(51) Int. Cl.
*B41F 15/46* (2006.01)
*B41F 15/36* (2006.01)
*B41F 15/42* (2006.01)
*B41F 16/02* (2006.01)

(58) Field of Classification Search
CPC ..... B41F 15/0836; B41F 15/14; B41F 15/34; B41F 15/38; B41F 15/40; B41F 15/44; B41P 2215/13; B41P 2215/132
USPC ..... 101/219
See application file for complete search history.

(56) References Cited

U.S. PATENT DOCUMENTS 4,063,501 A * 12/1977 Lotte ..... B41F 15/0836 101/128.1
4,366,542 A * 12/1982 Anselrode ..... B41F 33/16 101/116
5,375,516 A * 12/1994 Hasegawa ..... B41L 13/04 101/115
2009/0193991 A1* 8/2009 Rossini ..... B41N 10/04 101/453

FOREIGN PATENT DOCUMENTS

CN 201249560 Y * 6/2009
CN 103879163 A 6/2014
CN 204249520 U 4/2015
CN 205220010 U 5/2016
CN 206231040 U 6/2017
EP 1632349 A2 3/2006

* cited by examiner

HORIZONTAL ROTARY SCREEN TRANSFER PRINTING APPARATUS

BACKGROUND

Technical Field

The instant disclosure relates to printing and dyeing machinery for the textile industry, and in particular to, a horizontal rotary screen transfer printing apparatus.

Related Art

The rotary screen printing machine was initiated by the Stork Company in 1963. Although its history is not long, the rotary screen printing machine has developed rapidly. The rotary screen printing machine has the advantages of low labor intensity, high production efficiency, and strong adaptability to fabrics. The rotary screen printing machine is suitable for printing chemical fiber fabrics, knitted fabrics, and light fabrics, so that an effect of vivid pattern types and bright colors can be obtained, and a defect of color transfer can be avoided. Therefore, in the past two or three decades, the rotary screen printing machine has become the mainstream printing and dyeing machinery for textile printing, and has been widely used in printing production in China. Since the introduction of the rotary screen printing machine into China in 1973, the original roller printing machine is gradually replaced with the rotary screen printing machine. Because of the use of the rotary screen printing machine, the production efficiency is improved, costs are reduced, and operational labor intensity is reduced, so that the rotary screen printing machine is very popular in printing enterprises, and domestic rotary screen printing machines have also obtained considerable technological progress. However, the rotary screen printing machine is limited by the structure of the rotary screen, and an effect of printing fine lines is not quite ideal. Among many printing technologies and apparatuses, for example, rotary screen printing, flat screen printing, roller printing, platen printing, transfer printing, and digital inkjet printing, the transfer printing has received attention due to high printing precision, strong layering, and adaptability to mass production, and has grown rapidly in recent years. Early transfer printing mainly adopted a heat transfer printing process, that is, a printing method in which a certain dye is first printed on other materials such as paper, and then the pattern is transferred to the fabric through hot pressing or the like. In recent years, in addition to heat transfer printing, cold transfer printing has been developed rapidly. Cold transfer printing is to use a water-based color paste to print a pattern onto a piece of coated paper, transfer the pattern to the fabric at room temperature, develop the color through a cold pile or steaming, and finally wash the pattern to remove the floating color, thereby completing an entire printing process. Transfer printing has the imitation digital printing quality and may be produced in high volumes, of which costs are much lower than that of digital printing, and therefore the market prospect is broad; however, consumption of transfer paper becomes an obstacle to green production thereof.

In the field of transfer printing, either heat transfer printing or cold transfer printing mostly uses gravure as a plate roller for printing, to reflect a characteristic of line fineness. However, some companies applied the rotary screen to the field of transfer printing; and also made attempts before commercial production. For example, in the technical solution disclosed in the China patent application (CN99812635.7), "Pattern carrier used in the transfer method, and application of amorphous syrup to the dispersion liquid of the coated paper for obtaining the carrier", in Embodiments 1, 3, and 4 of the application, a Stock RT printing and dyeing machine is used, the printing paper is transferred through rotary screen printing, and then used for transfer painting. However, the rotary screen printing machine for printing is used to print paper, though the application adopts the advantage that the rotary screen relative to an intaglio plate has a large amount of ink, printing fineness of the rotary screen is inferior to that of the intaglio plate.

SUMMARY

The instant disclosure is to provide a novel horizontal rotary screen transfer printing apparatus, which can be used to overcome at least one of the disadvantages of an existing printing apparatus.

According to one aspect of the instant disclosure, a horizontal rotary screen transfer printing apparatus is provided, including a rack, at least two rotary screen transfer assemblies horizontally arranged on the rack, and a back-pressure roller. The horizontal rotary screen transfer printing apparatus is characterized in that each rotary screen transfer assembly includes a rotary screen plate roller and a transfer roller arranged parallel to each other, the rotary screen plate roller transfers a pattern onto the transfer roller serving as a temporary transfer carrier, and the transfer roller transfers the pattern onto a fabric passing in a horizontal direction between the back-pressure roller and the transfer roller.

Preferably, proper actuators are provided at two ends of the transfer roller, respectively, for driving the transfer roller to control a distance between the rotary screen plate roller and the transfer roller.

Preferably, the rotary screen transfer assemblies are fixed within a bracket outer frame.

Preferably, two ends of the back-pressure roller and the transfer roller are supported by support shafts, respectively, and are fixed opposite to each other on two sides of a lower end portion of the bracket outer frame.

Preferably, the rotary screen transfer assembly includes a rotary screen transfer assembly pressure application cylinder, and the rotary screen transfer assembly pressure application cylinder is fixed above the bracket outer frame for applying a pressure to the rotary screen transfer assembly to cause the transfer roller to move close to or away from the back-pressure roller.

Preferably, two bracket lifting cylinders are provided for lifting the bracket outer frame to replace the rotary screen plate roller, where one of two ends of a piston rod of each bracket lifting cylinder is supported on the bracket outer frame, and the other end of each bracket lifting cylinder is fixed to the rack.

Preferably, eight rotary screen transfer assemblies are mounted within a length of the rack depending on requirements for pattern colors or color overlaps.

Preferably, a drying apparatus is disposed between the rotary screen transfer assemblies.

Preferably, the drying apparatus is an infrared drying apparatus or a hot air drying apparatus.

Preferably, a conveyor belt being annular is provided, the rotary screen transfer assembly is mounted perpendicular to the conveyor belt, and the rotary screen transfer assembly pressure application cylinder applies a pressure in a direction perpendicular to the conveyor belt.

Preferably, a diameter of the transfer roller is the same as a diameter of the rotary screen plate roller, or is an integral multiple of the diameter of the rotary screen plate roller.

Preferably, a surface of the transfer roller is coated with seamless rubber or resin to have a good affinity for water-based ink.

Preferably, the surface of the transfer roller has a Shore hardness between 70 and 85.

Preferably, the back-pressure roller is a metal roller or a rubber roller.

Preferably, the back-pressure roller is a rotatable but immovable roller.

Preferably, a scraper assembly is further disposed in each rotary screen transfer assembly, the scraper assembly includes a scraper disposed in the rotary screen plate roller, and a location and a pressure of the scraper relative to the rotary screen plate roller are adjusted using a scraper adjustment mechanism.

According to the instant disclosure, the scraper adjustment mechanism includes a primary adjustment mechanism and a secondary adjustment mechanism, where the primary adjustment mechanism includes a swing arm and a swing arm actuating apparatus for actuating the swing arm. The swing arm includes a first swing arm portion and a second swing arm portion, one of two ends of the first swing arm portion is connected to the swing arm actuating apparatus, and the other end of the first swing arm portion is fixedly connected to the second swing arm portion at an angle. A pivot portion is provided on the first swing arm portion, so that the first swing arm portion is pivotable around the pivot portion. The pivoting of the first swing arm portion allows the second swing arm portion to move accordingly, and the movement of the second swing arm portion allows the scraper to move close to or away from an inner surface of the rotary screen plate roller. The secondary adjustment mechanism includes a secondary scraper pressure adjustment assembly and a secondary scraper position adjustment assembly, where the secondary scraper pressure adjustment assembly is arranged on the first swing arm portion for adjusting a contact pressure between the scraper and the rotary screen, and the secondary scraper position adjustment assembly is arranged on the second swing arm portion for adjusting a position of the scraper in the rotary screen.

Preferably, the secondary scraper pressure adjustment assembly includes a pressing member, and the pressing member is configured to change a force applied to an end of the first swing arm portion which is close to the swing arm actuating apparatus, so that the contact pressure between the scraper and the rotary screen is adjusted through the pivot of the swing arm around the pivot portion.

Preferably, the secondary scraper pressure adjustment assembly further includes a pressure adjustment sliding member, where the pressure adjustment sliding member can be slidably engaged with the pressing member, and the sliding of the pressure adjustment sliding member causes the force applied to the first swing arm portion by the pressing member to change.

Preferably, the pressure adjustment sliding member has an inclined surface whose height gradually changes, and the inclined surface may be slidably engaged with an outer surface of the pressing member. When the pressure adjustment sliding member slides, because the height of the inclined surface gradually changes, the contact force between the inclined surface and the outer surface of the pressing member is changed, so that the force applied to the first swing arm portion by the pressing member is changed.

Preferably, the pressing member has a cylindrical shape.

Preferably, the pressing member is a cylindrical rolling bearing that can roll around a central axis of the rolling bearing.

Preferably, the secondary scraper pressure adjustment assembly further includes a pressure adjustment hand wheel and a pressure adjustment screw nut mechanism, the pressure adjustment hand wheel is connected to one of two ends of the pressure adjustment screw nut mechanism which is close to the second swing arm portion, and the pressure adjustment sliding member is connected to the other end of the pressure adjustment screw nut mechanism. When the pressure adjustment hand wheel is rotated, the pressure adjustment sliding member slides through the pressure adjustment screw nut mechanism.

Preferably, the first swing arm portion has a rectangular cross section, the first swing arm portion has a hollow cavity extending along an axial direction thereof, and a slit is disposed on an upper wall of the one end of the first swing arm portion which is close to the swing arm actuating apparatus, the slit extends through the upper wall and extends along an axial direction of the first swing arm portion, where the pressure adjustment sliding member passes through the slit and is located on the upper wall of the first swing arm portion, so that the pressure adjustment sliding member has a first sliding portion outside the first swing arm portion and a second sliding portion in the hollow cavity of the first swing arm portion. The inclined surface of the pressure adjustment sliding member is located on the first sliding portion, and the pressure adjustment screw nut mechanism is located in the hollow cavity of the first swing arm portion and connected to the second sliding portion in the hollow cavity of the first swing arm portion, so that the pressure adjustment sliding member can slide along a direction in which the slit extends.

Preferably, the secondary scraper position adjustment assembly further includes a position adjustment hand wheel, a position adjustment screw nut mechanism, a position adjustment sliding member, where the position adjustment hand wheel is connected to one of two ends of the position adjustment screw nut mechanism which is away from the first swing arm portion, the position adjustment sliding member is located at the other end of the position adjustment screw nut mechanism, and the scraper assembly is connected to the position adjustment sliding member and can move together with the position adjustment sliding member.

Preferably, the secondary scraper position adjusting assembly further includes a scraper fixing hand wheel, and after the scraper is adjusted to an appropriate position using the secondary scraper position adjustment assembly, the scraper fixing hand wheel is used to fix the scraper at an adjusted location.

Preferably, the position adjustment sliding member is connected to the other end of the position adjustment screw nut mechanism.

Preferably, the position adjustment sliding member abuts against the other end of the position adjustment screw nut mechanism.

Preferably, the second swing arm portion has a rectangular cross section, and the second swing arm portion has a hollow cavity extending along an axial direction thereof. The position adjustment sliding member and the position adjustment screw nut mechanism of the secondary scraper position adjustment assembly are both located in a hollow cavity of the second swing arm portion, a first slit is disposed on the second swing arm portion, and the scraper assembly is connected to the position adjustment slide member through the first slit.

Preferably, the second swing arm portion further includes a second slit, the second slit and the first slit are disposed on different walls of the second swing arm portion, and the scraper fixing hand wheel is threaded to the position adjustment sliding member through the second slit.

Preferably, when the scraper fixing hand wheel is loosened, the scraper fixing hand wheel, the position adjustment sliding member, and the scraper assembly can move together along a same direction. When the scraper fixing hand wheel is tightened, the position adjustment sliding member and the scraper assembly are both fixed.

Preferably, the first swing arm portion and the second swing arm portion are formed as an integral structure.

Preferably, the first swing arm portion and the second swing arm portion are formed as separated structures.

According to the instant disclosure, alternatively, the scraper adjustment mechanism includes a swing arm and a swing arm actuating apparatus for actuating the swing arm. The swing arm includes a first swing arm portion and a second swing arm portion, one of two ends of the first swing arm portion is connected to a swing arm actuating apparatus, and the other end of the first swing arm portion is fixedly connected to the second swing arm portion at an angle. A pivot portion is disposed on the first swing arm portion, so that the first swing arm portion is pivotable around the pivot portion when being actuated by the swing arm actuating apparatus. The pivoting of the first swing arm portion allows the second swing arm portion to move accordingly, and the movement of the second swing arm portion allows the scraper to move close to or away from an inner surface of the rotary screen plate roller, thereby adjusting a position of the scraper in the rotary screen plate roller and the contact pressure between the scraper and the rotary screen plate roller.

According to the alternative implementation of the scraper adjustment mechanism of the instant disclosure, an angle between the first swing arm portion and the second swing arm portion is an obtuse angle.

Based on the development of high mesh-number rotary screens in recent years and the fact that the costs of rotary screen platemaking are much lower than that of intaglio printing, the horizontal rotary screen transfer printing apparatus according to the instant disclosure uses a rotary screen printing plate to print a pattern onto a transfer roller, and prints the pattern onto the fabric through the transfer roller, thereby not only reducing the platemaking costs, but also achieving paperless transfer printing.

Furthermore, the scraper adjustment mechanism adopted in the instant disclosure can adjust the position and the pressure of the scraper accurately, and is simple in structure, is easy to adjust, and has low costs. The scraper adjustment mechanism having the foregoing configuration adopts a two-stage adjustment manner. First, the scraper is adjusted to the appropriate position in the rotary screen using the primary adjustment mechanism; then, according to the actual needs (for example, according to the printing speed, the type of scraper used, etc.), the position of the scraper in the rotary screen and the contact pressure between the scraper and the rotary screen plate roller are more finely adjusted through the secondary scraper position adjustment assembly and the secondary scraper pressure adjustment assembly. Fine adjustment can be performed through the secondary scraper position adjustment assembly and the secondary scraper pressure adjustment assembly, so that the print quality of the rotary screen printing is improved, the wear of the scraper and the rotary screen is reduced, and the service lives of the scraper and the rotary screen are extended. The secondary scraper position adjustment assembly and the secondary scraper pressure adjustment assembly having the foregoing configuration can be easily adjusted manually, which is more convenient to adjust in comparison to the prior art device. In addition, the secondary scraper position adjustment assembly and the secondary scraper pressure adjustment assembly are mainly arranged inside the primary adjusting mechanism, which not only reduces the space occupied by the two assemblies and facilitates the arrangement of the device, but also can protect the secondary scraper position adjustment and the secondary scraper pressure adjustment assembly from being affected or damaged by the external environment.

Other objects, features, and details of the instant disclosure will become fully apparent with reference to the following detailed description of exemplary embodiments and the accompanying drawings and in accordance with the appended claims.

A person skilled in the art should understand the advantages of the embodiments and various additional embodiments by reading the following detailed description of the embodiments with reference to the corresponding accompanying drawings listed below. In addition, various features of the accompanying drawings discussed below are not necessarily drawn to scale. Dimensions of various features and elements in the accompanying drawings may be expanded or reduced to more clearly illustrate the embodiments of the instant disclosure.

BRIEF DESCRIPTION OF THE DRAWINGS

The instant disclosure is further described with reference to the accompanying drawings and the embodiments, and a same reference label refers to similar or the same elements throughout the accompanying drawings and the descriptions of the accompanying drawings.

DETAILED DESCRIPTION

Figure 1:
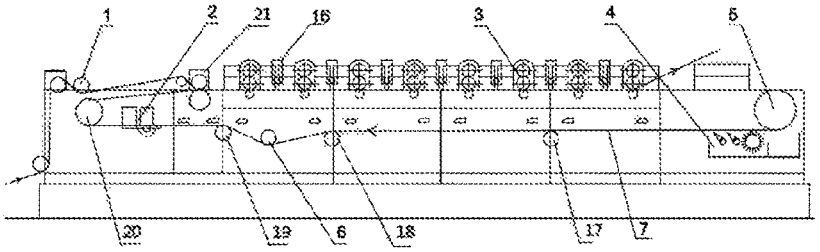
FIG. 1 is a side view of a horizontal rotary screen transfer printing apparatus.

The technical solutions of the instant disclosure are further described in detail below by the description of the accompanying drawings and the enumeration of the embodiments of the instant disclosure. It should be noted that any technical features and any technical solutions in the embodiments do not limit the protection scope of the instant disclosure. The protection scope of the instant disclosure should include any alternative technical solutions that may be figured out by a person skilled in the art without creative efforts.

In this specification, various systems, structures, and devices are schematically depicted in the accompanying drawings for purposes of explanation only, but all features of actual systems, structures, and devices such as well-known functions or structures are not described in detail to avoid unnecessary details that obscure the instant disclosure. Certainly, it should be understood that in any practical application, many specific implementation decisions need to be made to achieve the specific goals of developers or users, the system-related and industry-related restrictions need to be followed, and the specific goals may vary according to the actual application. In addition, it should be understood that such specific implementation decisions, while complex and time consuming, are routine tasks for those of ordinary skill in the art who benefit from this application.

The terms and phrases used herein should be understood and interpreted as having a meaning consistent with the understanding of these terms and phrases by those skilled in the relevant art. The consistent usage of terms or phrases herein is not intended to imply a particular definition of terms or phrases, that is, a definition that is different from an ordinary and customary meaning understood by those skilled in the art. For terms or phrases intended to have a special meaning, that is, a meaning different from what a skilled person understands, the special definition will be explicitly listed in the specification in a defined manner, and the special definition of terms or phrases will be given directly and unequivocally.

Unless required by the content, in the entire specification and claims below, the word "include/comprise" and its variants, such as "including", are to be interpreted in an open, inclusive sense, that is, "including but not limited to".

Throughout the description of this specification, the description of the reference terms such as "an embodiment", "one embodiment", "some embodiments", "example", "specific example", or "some examples" means that the specific features, structures, materials or characteristics described with reference to the embodiment or example are included in at least one embodiment or example of the instant disclosure. Therefore, the phrase such as "in one embodiment" or "in an embodiment" that appears in different places throughout the specification does not necessarily refer to the same embodiment. Moreover, the specific features, structures, materials, or characteristics described may be combined in any one or more embodiments or examples in an appropriate manner.

As used in this specification and the appended claims, unless otherwise specified and limited, the singular form of the indefinite article "a" and the definite article "the" include one or more reference objects. It should also be noted that, unless otherwise specified and limited, the term "or" generally includes "and/or" in terms of meaning. For the purposes of explanation, a phrase in the form of "A or B" means "(A), (B) or (A and B)". For the purpose of explanation, a phrase in the form of "at least one of A, B, or C" means "(A), (B), (C), (A and B), (A and C), (B and C) or (A, B, and C)".

Moreover, the terms "first", "second", and the like are used for descriptive purposes only and are not to be construed as indicating or implying a relative importance or implicitly indicating the number of technical features indicated. Therefore, features defined by "first", "second", and the like may include one or more of the features, either explicitly or implicitly. In the description of the instant disclosure, unless otherwise specifically defined, "a plurality of" means two or more.

In the instant disclosure, unless otherwise explicitly specified or defined, the terms such as "mount", "install", "connect", "connection", and "fix" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two components. Persons of ordinary skill in the art may understand the specific meanings of the foregoing terms in instant disclosure according to specific situations.

According to an embodiment of the instant disclosure, for the horizontal rotary screen transfer printing apparatus that is provided, reference is made to FIG. 1. The horizontal rotary screen transfer printing apparatus includes a rack on which at least two rotary screen transfer assemblies 3 (also referred to as print color group units) are horizontally arranged. For example, a plurality of rotary screen transfer assemblies 3 may be mounted within a length of the rack depending on requirements for pattern colors or color overlaps, and eight rotary screen transfer assemblies 3 are preferably mounted. Drying apparatuses 16 are mounted between the rotary screen transfer assemblies 3, respectively. The drying apparatus 16 is an infrared drying apparatus or a hot air drying apparatus, preferably the infrared drying apparatus. The rotary screen transfer members 3 and the drying apparatuses 16 are located on an upper side of a conveyor belt 7.

The conveyor belt 7 is an annular conveyor belt, so that the conveyor belt 7 may move in a loop in the horizontal rotary screen transfer printing apparatus. After being separated from the finished printed fabric, firstly the conveyor belt 7 is transmitted via a conveyor belt transmission apparatus 5 through a conveyor belt cleaning apparatus 4 downstream of the conveyor belt transmission apparatus 5. The conveyor belt cleaning apparatus 4 is configured to wash the ink that may penetrate fabrics and that is left on the conveyor belt 7 during the printing process, preferably a water spray cleaning apparatus, and a brush is disposed downstream of the water spray cleaning apparatus. A first conveying roller 17, a second conveying roller 18, a third conveying roller 19, and a bending roller 20 are successively disposed downstream of the conveyor belt cleaning apparatus 4, where top ends of the first conveying roller 17 and the second conveying roller 18 and a bottom end of the conveyor belt transmission apparatus 5 are substantially in a same horizontal plane (in practice, it is also feasible to be at different horizontal planes), and a top end of the third conveying roller 19 is substantially at the same horizontal plane as the bottom end of the bending roller 20 (in practice, it is also feasible to be at different horizontal planes). The conveyor belt 7 is continuously conveyed forward via three conveying rollers 17, 18, and 19, where a conveyor belt correction apparatus 6 is disposed between the second conveying roller 18 and the third conveying roller 19, and the conveyor belt is strained and pinpointed via the conveyor belt correction apparatus 6. A conveyor belt gluing apparatus 2 for gluing the conveyor belt 7 is disposed between the third conveying roller 19 and the bending roller 20, and the glued conveyor belt 7 easily bonds with the to-be-printed fabric and is not easily loosened during the printing process. After the fabric is glued through the conveyor belt gluing apparatus 2. The fabric is turned via the bending roller 20, then the conveyor belt 7 enters into a bonding apparatus 21 to be planarly bonded with the to-be-printed fabric, and then the fabric is guided into the rotary screen transfer assembly 3 and the drying apparatus 16 for printing. Upon completion of the printing, the finished printed fabric is separated from the conveyor belt 7, and the conveyor belt 7 is transferred, using the conveyor belt transmission apparatus 5, to the conveyor belt cleaning apparatus 4 again for cleaning, to restart a next cycle.

The to-be-printed fabric is brought into the bonding device 21 via a fabric feeding apparatus 1 and bonds with the conveyor belt 7. After the finished printed fabric leaving the rotary screen transfer assembly 3 is separated from the conveyor belt 7, a subsequent process of color fixing, water wash and the like is performed.

Next, one of the rotary screen transfer assemblies 3 of FIG. 1 is described in detail with reference to FIG. 2. The rotary screen transfer assembly 3 is fixed in a bracket outer frame 11, and the bracket outer frame 11 is fixed to the rack of the horizontal rotary screen transfer printing apparatus using bolts. The rotary screen transfer assembly 3 further includes a rotary screen plate roller 10 (also referred to as a rotary screen printing plate) 10, a scraper, a transfer printing roller 14 (also referred to as a transfer roller), a bracket lifting cylinder 12, and a rotary screen transfer assembly pressure application cylinder 15, a scraper assembly adjustment mechanism, and an adjustment mechanism pressure application apparatus.

Two ends of the rotary screen plate roller 10, the transfer roller 14, and the back-pressure roller 13 are respectively supported in the bracket outer frame 11 by support shafts (not shown), where the transfer roller 14 and the back-pressure roller 13 are fixed at two sides of a lower end of the bracket outer frame 11. The back-pressure roller 13 is disposed opposite to the transfer roller 14, and the conveyor belt 7 and the fabric pass between the back-pressure roller 13 and the transfer roller 14. The back-pressure roller 13 is a metal roller or a rubber roller.

The rotary screen plate roller 10 and the transfer roller 14 may be driven using dual servo motors, that is, the rotary screen plate roller 10 and the transfer roller 14 are driven by independent servo motors, respectively; or may be driven by a single servo motor, that is, the transfer roller 14 is driven by a servo motor, and the rotary screen plate roller 10 is driven by the servo motor through a gear transmission mechanism to rotate.

Two bracket lifting cylinders 12 are provided for lifting the bracket outer frame 11 so as to replace the rotary screen plate roller 10, where one of two ends of a piston rod of each bracket lifting cylinder is supported on the bracket outer frame 11 and the other end of each bracket lifting cylinder is fixed to the rack.

The rotary screen transfer assembly pressure application cylinder 15 is fixed above the bracket outer frame 11 for applying a pressure to the entire rotary screen transfer assembly 3 to allow the transfer roller 14 to move close to or away from the back-pressure roller 13. In the horizontal rotary screen transfer printing apparatus according to FIG. 1, the rotary screen transfer assembly 3 is mounted perpendicular to the conveyor belt 7, and the rotary screen transfer assembly pressure application cylinder 15 applies a pressure in a direction downward and perpendicular to the conveyor belt 7. The rotary screen printing plate 10 and the transfer roller 14 are arranged along their axial extension directions and parallel to each other.

An outer peripheral surface of the rotary screen printing plate 14 and a peripheral surface of the transfer roller 13 may abut against or may be separated from each other. In particular, in one embodiment, proper actuators (such as a-hydraulic cylinders, pneumatic cylinders, or electric cylinders) (not shown) are provided at two ends of the transfer roller 14 for driving the transfer roller 14 to selectively move the transfer roller 14 to a close position or a remote position. In the close position, the transfer roller 14 abuts against the rotary screen plate roller, so that a gap between the rotary screen plate roller and the transfer roller 14 is 0.3±0.1 mm; in the remote position, the transfer roller 14 does not abut against the rotary screen plate roller 10. Therefore, firstly a pattern is printed onto the transfer roller 14 using the rotary screen plate roller 10, and then the pattern is printed onto the fabric 8 through the transfer roller 14, thereby not only reducing the platemaking costs, but also achieving paperless transfer printing.

A diameter of the transfer roller 14 is the same as a diameter of the rotary screen plate roller 10 or may be an integral multiple of the diameter of the rotary screen plate roller 10. A surface of the transfer roller 14 is coated with seamless rubber or resin, and therefore has a good affinity for water-based ink. A Shore hardness of the surface is between 70 and 85.

The back-pressure roller 13 is a metal roller or a rubber roller, and is a rotatable but immovable roller.

When the fabric 8 is used as an example, the process of printing the fabric by the horizontal rotary screen transfer printing apparatus of the instant disclosure is as follows.

After the fabric 8 is accurately positioned by a tension adjustment apparatus and a correction apparatus, along with the rotation of the center roller driven by a center roller servo motor, the fabric 8 is driven to enter into the horizontal rotary screen transfer printing apparatus through a guide roller. Next, referring to FIG. 1 and FIG. 2, after passing through the fabric feeding apparatus 1, the fabric 8 is bonded to the glued conveyor belt 7, and then enters into the rotary screen transfer assembly 3 for printing. Actuators at two ends of the transfer roller 14 are controlled, so that the rotary screen plate roller 10 in the rotary screen transfer assembly 3 is brought close to the transfer roller 14, and a pressure applied to the rotary screen using a scraper disposed in the rotary screen plate roller enables the pattern to be printed on the transfer roller 14 as an automatic and continuous ink supply system runs. Then, a pressure is applied to the entire rotary screen transfer assembly 3 by the rotary screen transfer assembly pressure application cylinder 15, thus allowing the transfer roller 14 to transfer the pattern onto the fabric 8. During this period, an automatic control system controls speeds of each rotary screen transfer assembly 3 and the applied pressure using the servo motor, performs color register and printing using a plurality of rotary screen transfer assemblies. Then the printed fabric 8 is taken out together with the conveyor belt 7 through the guide roller, and the subsequent steps of color fixing, water washing, and the like are performed. After passing through the printing area, the conveyor belt 7 is cleaned by the conveyor belt cleaning apparatus 4, is corrected again by the conveyor belt correction apparatus 6, and then runs in another circle.

A scraper assembly 104 (which may also be referred to as a squeegee mechanism) is disposed inside a hollow interior of the rotary screen printing plate 10 and extends along an axial direction of the rotary screen printing plate 10. The scraper assembly 104 may be any suitable type applicable to a rotary screen transfer printing apparatus. For example, the scraper assembly 104 may include a color paste tube with a perforation, a scraper, a scraper fixture, a scraper holder, a splash guard, and the like. The scraper may be a rubber scraper, a metal scraper, a polymer material scraper, or the like. Preferably, the scraper may be a metal scraper having a certain elasticity, such as a steel scraper. The scraper should be selected based on a fabric variety and a pattern structure to ensure proper pulp and permeability for obtaining a desired printing effect.

The scraper is mounted on a suitable scraper holder using the scraper holder, the scraper holder may be laterally moved and rotated inside the rotary screen printing plate, to adjust a position, a direction, and a contact pressure between the scraper and an inner surface of the rotary screen printing plate. The adjustment is performed by a scraper assembly adjustment mechanism in accordance with the instant disclosure, as will be described in detail below.

Figure 2:
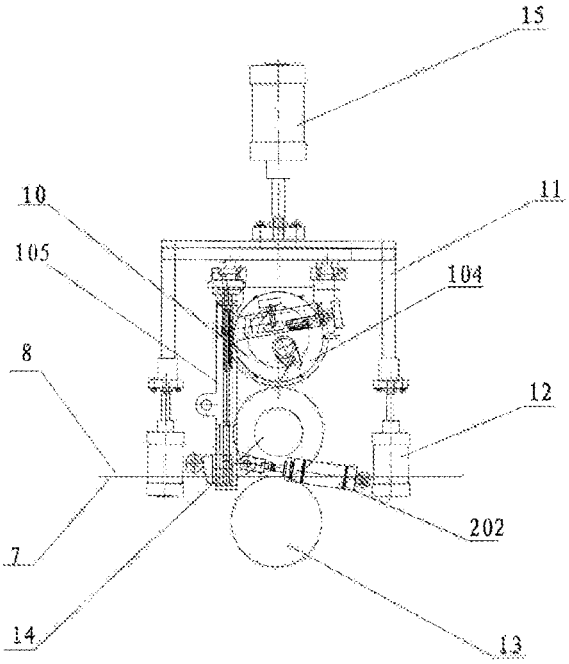
FIG. 2 is a cross-sectional view of a horizontal rotary screen transfer printing apparatus.
Figure 3:
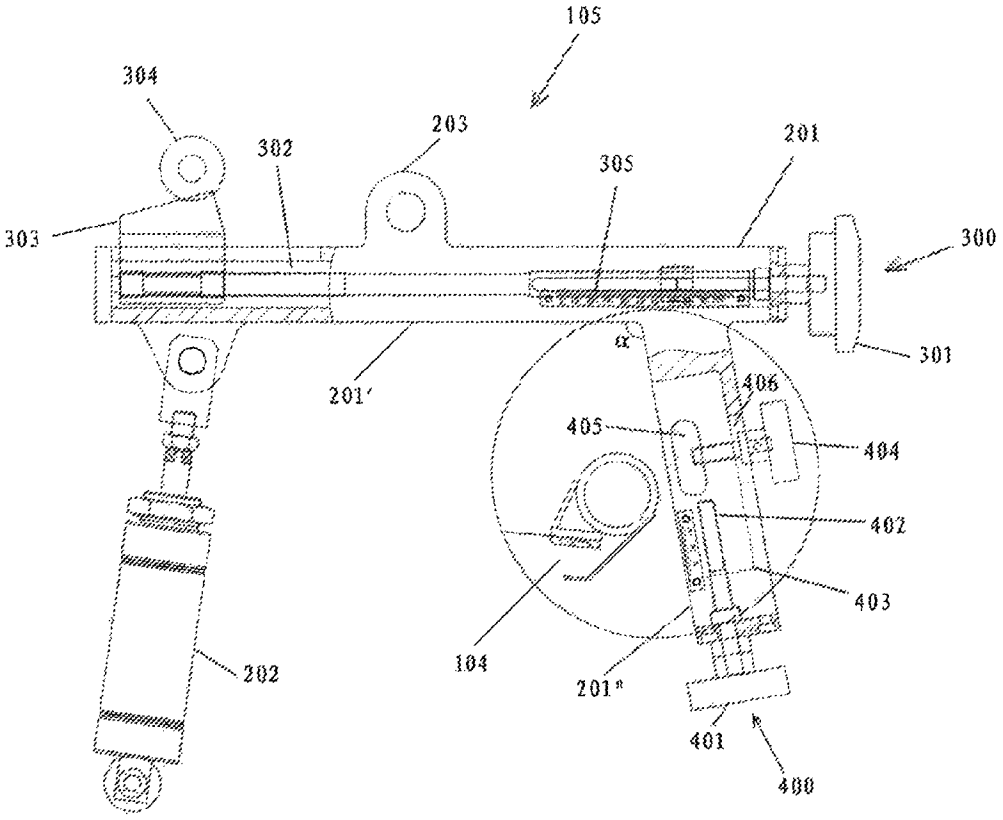
FIG. 3 is an enlarged partial cross-sectional view of a scraper adjustment mechanism shown in FIG. 2.

As shown in FIG. 2 and FIG. 3, a scraper assembly 104 (also referred to as a "squeegee mechanism") is further provided on each rotary screen transfer assembly, the scraper assembly 104 includes a scraper mounted on the scraper holder, and the scraper is disposed in a rotary screen plate roller 10. The scraper may be a metal scraper, a magnetic bar scraper, or a magnetic bar-scraper combined scraper. A position and a pressure of the scraper relative to the rotary screen plate roller 10 are adjusted using the scraper adjustment mechanism, thereby controlling the amount of ink.

A specific structure of a scraper adjustment mechanism 105 according to an embodiment of the instant disclosure is described below with reference to FIG. 3.

The scraper adjustment mechanism 105 includes a primary adjustment mechanism and a secondary adjustment mechanism. The primary adjustment mechanism includes a swing arm 201 and a swing arm actuating apparatus 202. The swing arm 201 is formed by two portions, a first swing arm portion 201' and a second swing arm portion 201". In the plane (that is, a paper plane) perpendicular to the axial direction of the rotary screen printing plate shown in FIG. 3, the first swing arm portion 201' is a swing arm portion that extends horizontally, and the second swing arm portion 201" is a swing arm portion that extends obliquely. One end of the second swing arm portion 201" is fixed to one of two ends of the first swing arm portion 201' at an angle, and the swing arm actuating apparatus 202 is pivotally connected to the other end of the first swing arm portion 201'. An angle $\alpha$ between the first swing arm portion 201' and the second swing arm portion 201" may be selected according to an actual situation. Preferably, an angle $\alpha$ between the first swing arm portion 201' and the second swing arm portion 201" is an obtuse angle.

The first swing arm portion 201' and the second swing arm portion 201" may be formed into separate members, respectively, and then the two members are fixedly connected (for example, through welding, etc.) to form the swing arm 201. Alternatively, the first swing arm portion 201' and the second swing arm portion 201" may be formed as an integral structure. In addition, cross sections of the first swing arm portion 201' and the second swing arm portion 201" (that is, cross sections perpendicular to the axial direction of the swing arm portions) are preferably rectangular, so that the first swing arm portion 201' and the second swing arm portion 201" have four flat outer surfaces. However, the instant disclosure is not limited thereto, and the first swing arm portion 201' and the second swing arm portion 201" may be designed to have cross sections of other suitable shapes.

A pivot portion 203 is disposed on the first swing arm portion 201'. In the embodiment according to FIG. 3, the pivot portion 203 has a pivot hole for receiving a swing arm pivot shaft (not shown), the swing arm pivot shaft may be fixedly mounted, for example, on a frame of a rotary screen transfer assembly, and the pivot hole allows the first swing arm portion 201' to rotate about the swing arm pivot shaft. An axial direction of the pivot hole is perpendicular to the paper plane shown in FIG. 3. The pivot hole may be disposed at any position between the two ends of the first swing arm portion 201' as required. Preferably, the pivot hole is disposed at a middle position close to the first swing arm portion 201'. In the embodiment shown in FIG. 3, the pivot hole is disposed in a protrusion that protrudes upward from an outer surface of the first swing arm portion 201', but the instant disclosure is not limited thereto. For example, the pivot hole may be disposed in a protrusion that protrudes rearward from the outer surface of the first swing arm portion 201'. The protrusion may be formed integrally with the first swing arm portion 201'. However, alternatively, the protrusion may be configured as a separate member, and then the protrusion is fixed to a suitable position of the first swing arm portion 201' by various ways such as welding, threaded connection, or the like. The protrusion may have any suitable shape and configuration, such as cylinder, polygon, etc. In addition, the pivot hole may be a through hole, or may be a blind hole as long as the blind hole can have a certain depth for receiving the pivot and can allow the swing arm 201 to rotate about the blind hole.

The scraper assembly 104 may be connected to the second swing arm portion 201" and may move together with the second swing arm portion 201".

The swing arm actuating apparatus 202 may be any type of pressure application apparatus, such as a pneumatic cylinder or a hydraulic cylinder. The swing arm actuating apparatus 202 is configured to actuate the swing arm 201 to adjust the position of the scraper assembly 104 in the rotary screen plate roller 10 through allowing the swing arm 201 to drive the scraper assembly 104 to move, thereby allowing the scraper moves close to or away from an inner surface of the rotary screen plate roller 10 in a certain orientation. The term "moves to an inner surface of the rotary screen plate roller 10" includes contact the rotary screen plate roller 10 with a certain pressure.

The process is specifically described using FIG. 3 as an example. The swing arm actuating apparatus 202 may apply a force at an end portion (that is, a bonding portion of two parts) of the first swing arm portion 201', so that the end portion of the first swing arm portion 201' moves upward or downward. In this case, the first swing arm portion 201' rotates around the swing arm pivot shaft at the position of the protrusion thereof, thereby allowing the other end (that is, an end at which the first swing arm portion 201' and the second swing arm portion 201" are connected) of the first swing arm portion 201 to move downward or upward. The movement of the first swing arm portion 201' allows a corresponding movement of the second swing arm portion 201", thereby allowing the scraper assembly 104 to move within the rotary screen plate roller 10 through the second swing arm portion 201" until the scraper moves to a desired position.

Further, according to an embodiment of the instant disclosure, the secondary adjustment mechanism of the scraper adjustment mechanism 105 for the horizontal rotary screen transfer printing apparatus includes a secondary scraper pressure adjustment assembly 300 and a secondary scraper position adjustment assembly 400. The secondary scraper pressure adjustment assembly 300 is disposed on the first swing arm portion 201' of the swing arm 201, and the secondary scraper position adjustment assembly 400 is disposed on the second swing arm portion 201" of the swing arm 201. The secondary scraper pressure adjustment assembly 300 and the secondary scraper position adjustment assembly 400 are configured to finely adjust the pressure and position of the scraper in the rotary screen plate roller 10, respectively.

Preferably, the fine adjustment is performed manually, and the fine adjustment is adapted to be performed after the scraper is substantially adjusted in place by the primary adjustment mechanism, so that the position and the pressure of the scraper can be adjusted and controlled simply, thereby facilitating in improving the printing quality of the horizontal rotary transfer printing apparatus and in reducing the wear of the scraper and the rotary screen.

Preferably, according to an embodiment of the instant disclosure, the first swing arm portion 201' and the second swing arm portion 2012" of the swing arm may each be designed to have a hollow cavity. In this way, the secondary scraper pressure adjustment assembly 300 may be disposed in the hollow cavity of the first swing arm portion 201', and the secondary scraper position adjustment assembly 400 is disposed in the hollow cavity of the second swing arm portion 201". On the one hand, with such design and arrangement manner, materials are reduced, and a weight of the entire scraper adjustment mechanism is reduced; on the other hand, the secondary scraper pressure adjustment assembly 300 and the secondary scraper position adjustment assembly 400 are arranged inside the hollow cavity of the swing arm 201, thereby reducing space occupied in the horizontal rotary transfer printing apparatus. Moreover, the secondary scraper position adjustment assembly 300 and the secondary scraper pressure adjustment assembly 400 can be protected from the external environment. However, the instant disclosure is not limited thereto, and the secondary scraper pressure adjustment assembly 300 and the secondary scraper position adjustment assembly 400 may be disposed in appropriate positions outside the swing arm 201 as needed.

The scraper pressure adjustment assembly 300 mainly includes a pressure adjustment hand wheel 301, a pressure adjustment screw nut mechanism 302, a pressure adjustment sliding member 303, and a pressing member 304. The pressure adjustment screw nut mechanism 302 extends in the axial direction of the first swing arm portion 201', and is preferably disposed inside the hollow cavity of the first swing arm portion 201'. One end (as shown in FIG. 3, the end is an end away from the end of the swing arm actuating apparatus 202, that is, the end close to the second swing arm portion 201") of the pressure adjustment screw nut mechanism 302 is connected to the pressure adjustment hand wheel 301, and the other end (as shown in FIG. 3, the end is an end close to the swing arm actuating apparatus 202, that is, the end away from the second swing arm portion 201") is connected to the pressure adjustment sliding member 303.

An upper wall of the first swing arm portion 201' is provided with a slit, the slit is located at one end of the first swing arm portion 201' which is close to the swing arm actuating apparatus 202, and the slit runs through the upper wall and extends a certain length along the axial direction of the first swing arm portion 201'. The pressure adjustment sliding member 303 is designed to be seated on the upper wall of the first swing arm portion 201' through the slit, and therefore is divided into two portions, that is, a first sliding portion located outside the first swing arm portion 201' and a second sliding portion located in the hollow cavity of the first swing arm portion 201'. The second sliding portion is connected to the pressure adjustment screw nut mechanism 302, so that the pressure adjustment sliding member 303 slides under the driving of the pressure adjustment screw nut mechanism 302. In this way, when the pressure adjustment hand wheel 301 is rotated, the pressure adjustment screw nut mechanism 302 is rotated, so that the pressure adjustment sliding member 303 can slide in a direction in which the slit extends in the slit.

As shown in FIG. 3, the first sliding portion of the pressure adjustment sliding member 303 has an inclined upper surface, so that a height of the first sliding portion gradually changes along the axial direction of the first swing arm portion 201'. In the embodiment shown in FIG. 3, the height of the first sliding portion gradually rises from left to right in the axial direction of the first swing arm portion 201'. However, the instant disclosure is not limited thereto. For example, the height of the first sliding portion may be designed to gradually decrease from left to right in the axial direction as needed.

The pressing member 304 is disposed above the pressure adjustment sliding member 303. Preferably, the pressing member 304 is disposed at a fixed position above the pressure adjustment sliding member 303. An inclined upper surface of the first sliding portion of the pressure adjustment sliding member 303 is used in cooperation with the pressing member 304, to adjust the contact pressure between the scraper and the rotary screen plate roller 10. In particular, firstly the scraper is adjusted to a proper position in substantial contact with the rotary screen plate roller 10 using the primary adjustment mechanism and/or the secondary scraper position adjustment assembly. In this case, the pressing member 304 is close to or in contact with the inclined upper surface of the first sliding portion of the pressure adjustment sliding member 303. Then, the pressure adjustment hand wheel 301 is rotated to allow the pressure adjustment sliding member 303 to move in a desired direction. Because the height of the inclined upper surface is gradually changed, the contact pressure between the pressing member 304 and the inclined upper surface and a force applied to the first swing arm portion 201' through the inclined upper surface gradually changes, thereby allowing the first swing arm portion 201' to make a small range of pivotal movement about the swing arm pivot shaft, thereby driving the scraper assembly 104 to move, and consequently changing the contact pressure between the scraper and the rotary screen plate roller 10.

In one embodiment according to the instant disclosure, the pressing member 304 has a cylindrical shape with an axial direction perpendicular to the paper plane in which FIG. 3 is located. Preferably, the pressing member 304 may be a cylindrical member (for example, a roller bearing or the like) rotatable about a central axis. In this case, because the pressing member 304 may roll on the inclined upper surface of the first sliding portion, the frictional force between the pressing member 304 and the inclined upper surface of the first sliding portion is relatively small. When the pressure is adjusted, the pressure adjustment sliding member 303 can be more easily slid relative to the pressing member 304, thereby reducing the force required for rotating the pressure adjustment hand wheel 301. In this way, the contact pressure between the scraper and the rotary screen can be manually adjusted more easily.

The secondary scraper pressure adjustment assembly may further include a pressure indicating element 305 for indicating a pressure adjustment amplitude. In the embodiment shown in FIG. 3, the pressure indicating element 305 includes a pressure scale and a pressure amplitude indicating element. The pressure scale is engraved with values indicating the pressure adjustment amplitudes. The pressure scale is fixed to an outer surface of the first swing arm portion, and to an end close to the pressure adjustment hand wheel. The pressure scale may be fixed to the first swing arm portion 201' in various connection manners, such as connecting using bolts, bonding, welding, and the like. The pressure amplitude indicating element is fixed to the pressure adjustment screw nut mechanism 302, and slides forward or rearward in the axial direction of the first swing arm portion 201' as the pressure adjustment screw nut mechanism 302 moves, thereby determining the pressure adjustment amplitude according to a value on the pressure scale which is indicated by the pressure amplitude indicating element. In the embodiment shown in FIG. 3, because the pressure amplitude indicating element is located inside a hollow cavity of the first swing arm portion 201', a slit extending in an axial direction of the first swing arm portion 201' is disposed at a corresponding position of the first swing arm portion 201', so that the pressure amplitude indicating element is visible. The slit has a length, in general, equal to or greater than the length of the pressure scale.

With reference to FIG. 3, a secondary scraper position adjustment assembly 400 in a scraper adjustment mechanism according to an embodiment of the instant disclosure is described in detail. After the scraper assembly 104 is substantially adjusted to the suitable position using the primary adjustment mechanism, the scraper position is further fine-tuned using the secondary scraper position adjustment assembly 400; or the scraper position is adjusted accordingly using the secondary scraper adjustment assembly 400 when the printing speed is changed.

The secondary scraper position adjustment assembly 400 mainly includes a position adjustment hand wheel 401, a position adjustment screw nut mechanism 402, a position adjustment sliding member 403, and a scraper fixing hand wheel 404. The position adjustment screw nut mechanism 402 extends in the axial direction of the second swing arm portion 201" and is preferably arranged inside the hollow cavity of the second swing arm portion 201". One of two ends (as shown in FIG. 3, the end is an end away from the first swing arm portion 201') of the position adjustment screw nut mechanism 402 is connected to the position adjustment hand wheel 401, and the other end (as shown in FIG. 3, the end is an end close to the first swing arm portion 201') is connected to the position adjustment sliding member 403.

Preferably, the position adjustment sliding member 403 is slidably disposed within a hollow cavity of the second swing arm portion 201". When the position adjustment hand wheel 401 is rotated, the position adjustment screw nut mechanism 402 is rotated, so that the position adjustment sliding member 403 can slide in an axial direction of the second swing arm portion 201" in the hollow cavity of the second swing arm portion 201".

Accordingly, a first slit 405 is provided at one end of the second swing arm portion 201" which is close to the position adjustment hand wheel 401. A scraper holder of the scraper assembly 104 is connected to the position adjustment sliding member 403 through the first slit 405 in any suitable manner, thereby being capable of moving up and down with the sliding of the position adjustment sliding member 403, to change the position of the scraper relative to the rotary screen plate roller 10. A length of the first slit 405 is designed to not interfere with the movement of the scraper assembly 104, so that the scraper assembly 104 can move freely within a desired range of displacement.

A second slit 406 extending in an axial direction of the second swing arm portion 201" is further disposed on the second swing arm portion 201", and the second slit 406 and the first slit 405 are disposed on different walls of the second swing arm portion 201". The scraper fixing hand wheel 404 is screwed to the position adjustment sliding member 403 through the second slit 406. When the scraper fixing hand wheel 404 is loosened, the scraper fixing hand wheel 404 can move up and down in a direction in which the second slit 406 extends in the second slit 406. Likewise, a length of the second slit 406 is designed to not interfere with the movement of the scraper fixing hand wheel 404, so that the scraper fixing hand wheel 404 can move freely within a desired range of displacement.

When the scraper position is adjusted, firstly the scraper fixing hand wheel 404 is loosened, and then the position adjustment hand wheel 401 is manually rotated, so that the position adjustment screw nut mechanism 402 is rotated, thereby driving the position adjustment sliding member 403 to slide up and down in a hollow cavity of the second swing arm portion 201". The position adjustment sliding member 403 further drives the scraper assembly 104 to move up and down, so that the scraper is finely adjusted to a desired position. After the scraper is adjusted to the desired position, the scraper fixing hand wheel 404 is tightened, and the scraper fixing hand wheel 404, a wall portion of the second swing arm portion 201"!, and the position adjustment sliding member 403 are tightly pressed to each other to fix the scraper assembly 104, so that the scraper assembly 104 can no longer be moved.

Optionally, the secondary scraper position adjustment assembly 400 further includes a position indicating element for indicating the position adjustment amplitude. The position indicating element may have a similar structure as the pressure indicating element, and is fixed to a suitable position of the second swing arm portion 201" in a similar connection manner. Details are not described herein again.

According to one embodiment of the instant disclosure, two scraper adjustment mechanisms 105 according to the instant disclosure may be provided at the two axial ends of the rotary screen plate roller 10. The two scraper adjustment mechanisms 105 may each have respective swing arm pivot shafts and pivot about respective pivot arms. However, the two scraper adjustment mechanisms 105 may also be coupled together by ways of a same swing arm pivot shaft, and is pivotable about the same swing arm pivot shaft. In this embodiment, preferably, each scraper adjustment mechanism 105 may be individually adjusted.

According to one embodiment of the instant disclosure, scraper adjustment mechanisms 105 according to the instant disclosure may be provided at each of the two axial ends of the rotary screen plate roller. The two scraper adjustment mechanisms 105 may each have respective swing arm pivot shafts and pivot about respective pivot arms. However, the two scraper adjustment mechanisms 105 may also be coupled together by ways of a same swing arm pivot shaft, and is pivotable about the same swing arm pivot shaft. In this embodiment, preferably, each scraper adjustment mechanism 105 may be individually adjusted.

The instant disclosure may include any feature, combination of features, or a summary thereof that are implicitly or explicitly disclosed herein, and is not limited to any of the limitations listed above. Any element, feature and/or structural arrangement described herein may be combined in any appropriate manner.

The specific embodiments disclosed above are exemplary only, and it is apparent to those skilled in the art who benefit from the teachings herein that the instant disclosure may be modified and implemented in a different but equivalent manner. For example, the method steps described above may be performed in a different order. In addition, the details of the structure or design shown herein are not limited except as described in the following claims. Therefore, it is apparent that changes and modifications may be made to the specific embodiments disclosed above, and all such variations are considered to fall within the scope and spirit of the instant disclosure. Therefore, the protection sought herein is set forth in the appended claims.

What is claimed is:

1. A horizontal rotary screen transfer printing apparatus comprising a rack, at least two rotary screen transfer assemblies horizontally arranged on the rack, and a back-pressure roller, wherein each rotary screen transfer assembly comprises a rotary screen plate roller and a transfer roller arranged parallel to each other, the rotary screen plate roller transfers a pattern onto the transfer roller serving as a temporary transfer carrier, and the transfer roller transfers the pattern onto a fabric passing in a horizontal direction between the back-pressure roller and the transfer roller;

wherein the rotary screen transfer assemblies are fixed within a bracket outer frame;

wherein two bracket lifting cylinders are provided for lifting the bracket outer frame so as to replace the rotary screen plate roller, wherein one of two ends of a piston rod of each bracket lifting cylinder is supported on the bracket outer frame, and the other end of each bracket lifting cylinder is fixed to the rack.

2. The horizontal rotary screen transfer printing apparatus according to claim 1, wherein actuators are provided at two ends of the transfer roller, respectively, for driving the transfer roller to control a distance between the rotary screen plate roller and the transfer roller.

3. The horizontal rotary screen transfer printing apparatus according to claim 1, wherein two ends of the back-pressure roller and the transfer roller are supported by support shafts, respectively, and are fixed opposite to each other on two sides of a lower end portion of the bracket outer frame.

4. The horizontal rotary screen transfer printing apparatus according to claim 1, wherein the rotary screen transfer assembly comprises a rotary screen transfer assembly pressure application cylinder, and the rotary screen transfer assembly pressure application cylinder is fixed above the bracket outer frame for applying a pressure to the rotary screen transfer assembly to cause the transfer roller to move close to or away from the back-pressure roller.

5. The horizontal rotary screen transfer printing apparatus according to claim 4, wherein a conveyor belt being annular is provided, the rotary screen transfer assembly is mounted perpendicular to the conveyor belt, and the rotary screen transfer assembly pressure application cylinder applies a pressure in a direction perpendicular to the conveyor belt.

6. The horizontal rotary screen transfer printing apparatus according to claim 1, wherein eight rotary screen transfer assemblies are mounted within a length of the rack depending on requirements for pattern colors or color overlaps.

7. The horizontal rotary screen transfer printing apparatus according to claim 1, wherein a drying apparatus is provided between the rotary screen transfer assemblies.

8. The horizontal rotary screen transfer printing apparatus according to claim 7, wherein the drying apparatus is an infrared drying apparatus or a hot air drying apparatus.

9. The horizontal rotary screen transfer printing apparatus according to claim 1, wherein a diameter of the transfer roller is the same as a diameter of the rotary screen plate roller, or is an integral multiple of the diameter of the rotary screen plate roller.

10. The horizontal rotary screen transfer printing apparatus according to claim 1, wherein a surface of the transfer roller is coated with seamless rubber or resin to have a good affinity for water-based ink.

11. The horizontal rotary screen transfer printing apparatus according to claim 10, wherein the surface of the transfer roller has a Shore hardness between 70 and 85.

12. The horizontal rotary screen transfer printing apparatus according to claim 1, wherein the back-pressure roller is a metal roller or a rubber roller.

13. The horizontal rotary screen transfer printing apparatus according to claim 1, wherein the back-pressure roller is a rotatable but immovable roller.

14. The horizontal rotary screen transfer printing apparatus according to claim 1, wherein a scraper assembly is further disposed in each rotary screen transfer assembly, the scraper assembly comprises a scraper disposed in the rotary screen plate roller, and a location and a pressure of the scraper relative to the rotary screen plate roller are adjusted using a scraper adjustment mechanism.

15. The horizontal rotary screen transfer printing apparatus according to claim 14, wherein the scraper adjustment mechanism comprises a primary adjustment mechanism and a secondary adjustment mechanism, wherein the primary adjustment mechanism comprises a swing arm and a swing arm actuating apparatus for actuating the swing arm, the swing arm comprises a first swing arm portion and a second swing arm portion, one of two ends of the first swing arm portion is connected to the swing arm actuating apparatus, the other end of the first swing arm portion is fixedly connected to the second swing arm portion at an angle, wherein a pivot portion is provided on the first swing arm portion, so that the first swing arm portion pivots about the pivot portion when being actuated by the swing arm actuating apparatus, a pivoting of the first swing arm portion allows the second swing arm portion to move accordingly, and a movement of the second swing arm portion allows the scraper to move close to or away from an inner surface of the rotary screen plate roller; and wherein the secondary adjustment mechanism comprises a secondary scraper pressure adjustment assembly and a secondary scraper position adjustment assembly, the secondary scraper pressure adjustment assembly is arranged on the first swing arm portion for adjusting a contact pressure between the scraper and the rotary screen plate roller, the secondary scraper position adjustment assembly is arranged on the second swing arm portion for adjusting a position of the scraper in the rotary screen plate roller.

16. The horizontal rotary screen transfer printing apparatus according to claim 14, wherein the scraper adjustment mechanism comprises a swing arm and a swing arm actuating apparatus for actuating the swing arm, the swing arm comprises a first swing arm portion and a second swing arm portion, one of two ends of the first swing arm portion is connected to the swing arm actuating apparatus, the other end of the first swing arm portion is fixedly connected to the second swing arm portion at an angle, wherein a pivot portion is disposed on the first swing arm portion, so that the first swing arm portion pivots about the pivot portion when being actuated by the swing arm actuating apparatus, a pivoting of the first swing arm portion allows the second swing arm portion to move accordingly, a movement of the second swing arm portion allows the scraper to move close to or away from an inner surface of the rotary screen plate roller, thereby adjusting a position of the scraper in the rotary screen plate roller and a contact pressure between the scraper and the rotary screen plate roller.

* * * * *